US011713619B2

(12) United States Patent
Negrello et al.

(10) Patent No.: US 11,713,619 B2
(45) Date of Patent: Aug. 1, 2023

(54) SCREENING DEVICE

(71) Applicant: SOMFY ACTIVITES SA, Cluses (FR)

(72) Inventors: Frédéric Negrello, Cluses (FR); Frédéric Maraval, Cluses (FR)

(73) Assignee: SOMFY ACTIVITES SA, Cluses (FR)

( * ) Notice: Subject to any disclaimer, the term of this patent is extended or adjusted under 35 U.S.C. 154(b) by 0 days.

(21) Appl. No.: 17/918,749

(22) PCT Filed: Apr. 13, 2021

(86) PCT No.: PCT/EP2021/059517

§ 371 (c)(1),
(2) Date: Oct. 13, 2022

(87) PCT Pub. No.: WO2021/209430

PCT Pub. Date: Oct. 21, 2021

(65) Prior Publication Data

US 2023/0124677 A1 Apr. 20, 2023

(30) Foreign Application Priority Data

Apr. 14, 2020 (FR) ..... 2003725

(51) Int. Cl.

| | |
|---|---|
| ***E06B 9/322*** | (2006.01) |
| ***E06B 9/38*** | (2006.01) |
| *E06B 9/323* | (2006.01) |

(52) U.S. Cl.

CPC ..... *E06B 9/38* (2013.01); *E06B 9/322* (2013.01); *E06B 9/323* (2013.01)

(58) Field of Classification Search

CPC . E06B 9/38; E06B 9/322; E06B 9/323; E06B 9/30; E06B 9/304; E06B 9/305;

(Continued)

(56) References Cited

U.S. PATENT DOCUMENTS 3,310,099 A * 3/1967 Hunter ..... E06B 9/32 160/171
5,274,499 A * 12/1993 Shopp ..... G03B 21/58 359/461

(Continued)

FOREIGN PATENT DOCUMENTS

| | | |
|---|---|---|
| EP | 3 059 376 | 8/2016 |
| JP | 2010-248803 | 11/2010 |

OTHER PUBLICATIONS

International Search Report dated Jul. 7, 2021, for PCT/EP2021/059517, 5 pp.

(Continued)

*Primary Examiner* — Johnnie A. Shablack
(74) *Attorney, Agent, or Firm* — Nixon & Vanderhye

(57) ABSTRACT

A screening device includes a rail, a drive shaft, a motorized drive device, including an electromechanical actuator, and an autonomous electrical power supply device, including a battery module. The battery module includes first and second mounting brackets, each arranged inside the rail and configured to hold the battery module inside the rail. The actuator includes third and fourth mounting brackets, each arranged inside the rail and configured to hold the actuator inside the rail. The brackets are identical. Furthermore, each of the brackets includes an opening, configured to accommodate the drive shaft.

20 Claims, 7 Drawing Sheets

(58) Field of Classification Search
CPC ..... E06B 9/306; E06B 9/307; E06B 9/308; E06B 9/68; E06B 9/72
See application file for complete search history.

(56) References Cited

U.S. PATENT DOCUMENTS

| | | | | |
|---|---|---|---|---|
| 6,446,693 | B1 * | 9/2002 | Anderson | E06B 9/32 160/84.02 |
| 6,516,858 | B1 * | 2/2003 | Anderson | E06B 9/32 429/100 |
| 6,536,503 | B1 * | 3/2003 | Anderson | E06B 9/322 242/375.3 |
| 6,655,441 | B2 * | 12/2003 | Wen | E06B 9/322 160/170 |
| 7,740,045 | B2 * | 6/2010 | Anderson | E06B 9/322 160/84.05 |
| 8,307,878 | B2 * | 11/2012 | Faller | E06B 9/322 160/310 |
| 8,540,005 | B2 * | 9/2013 | Baugh | E06B 9/322 160/310 |
| 8,752,607 | B2 * | 6/2014 | Anderson | E06B 9/262 160/171 |
| 8,820,388 | B2 * | 9/2014 | Mullet | E06B 9/322 160/310 |
| 8,939,190 | B2 * | 1/2015 | Mullet | E06B 9/322 160/DIG. 17 |
| 9,091,115 | B2 * | 7/2015 | Mullet | E06B 9/322 |
| 9,103,157 | B2 * | 8/2015 | Mullet | E06B 9/62 |
| 9,371,687 | B2 * | 6/2016 | Yu | E06B 9/262 |
| 9,470,040 | B2 * | 10/2016 | Hall | E06B 9/303 |
| 9,489,834 | B2 * | 11/2016 | Hall | E06B 9/326 |
| 9,663,986 | B2 * | 5/2017 | Mullet | E06B 9/42 |
| 9,810,020 | B2 * | 11/2017 | Adams | E06B 9/323 |
| 9,988,837 | B2 * | 6/2018 | Defenbaugh | E06B 9/322 |
| 10,655,384 | B2 * | 5/2020 | Foley | E06B 9/322 |
| 10,655,386 | B2 * | 5/2020 | Adams | E06B 9/38 |
| 10,781,631 | B2 * | 9/2020 | Huang | E06B 9/68 |
| 10,895,105 | B1 * | 1/2021 | Marchese | E06B 9/322 |
| 2004/0163774 | A1 * | 8/2004 | Nien | E06B 9/307 160/168.1 P |
| 2014/0311686 | A1 * | 10/2014 | Yu | E06B 9/68 160/84.02 |
| 2017/0067286 | A1 * | 3/2017 | Hall | E06B 9/38 |
| 2019/0119978 | A1 * | 4/2019 | Hall | H04L 12/2818 |
| 2022/0316272 | A1 * | 10/2022 | Huang | E06B 9/322 |
| 2022/0333438 | A1 * | 10/2022 | Huang | E06B 9/323 |

OTHER PUBLICATIONS

Written Opinion of the ISA dated Jul. 7, 2021, for PCT/EP2021/059517, 10 pp.
French Search Report dated Jan. 18, 2021, for FR2003725, 2 pp.

* cited by examiner

SCREENING DEVICE

CROSS-REFERENCE TO RELATED APPLICATION(S)

This application is the U.S. national phase of International Application No. PCT/EP2021/059517 filed Apr. 13, 2021 which designated the U.S. and claims priority to FR 2003725 filed Apr. 14, 2020, the entire contents of each of which are hereby incorporated by reference.

BACKGROUND OF THE INVENTION

Field of the Invention

The present invention relates to a screening device comprising a rail, a screen, a motorized drive device and an autonomous electrical power supply device. The screen is driven by an electromechanical actuator of the motorized drive device, which is supplied with electrical power by a battery module of the autonomous electrical power supply device. The electromechanical actuator and the battery module are arranged inside the rail.

Description of the Related Art

Generally, the present invention relates to the field of screening devices comprising a motorized drive device moving a screen, between at least a first position and at least a second position.

A motorized drive device comprises an electromechanical actuator of a movable shading or closing element, such as a blind with slats, a pleated blind or any other equivalent material, hereinafter referred to as a screen.

JP 2010 248 803 A is already known, which describes a screening device. The screening device comprises a rail, a screen, a motorized drive device and an autonomous electrical power supply device. The motorized drive device comprises an electromechanical actuator. In an assembled configuration of the screening device, the electromechanical actuator is arranged inside the rail, is configured to move the screen and is electrically connected to the autonomous electrical power supply device. The autonomous electrical power supply device comprises a battery module. In the assembled configuration of the screening device, the battery module is arranged inside the rail and comprises a first end and a second end, the second end being opposite the first end. The battery module comprises a battery, a first mounting bracket and a second mounting bracket. The first mounting bracket is arranged at the first end of the battery module. The second mounting bracket is arranged at the second end of the battery module. Each of the first and second mounting brackets is arranged inside the rail and configured to hold the battery module inside the rail, in the assembled configuration of the screening device.

However, this document is silent, on the one hand, relating to the mounting of the electromechanical actuator relative to the rail and, on the other hand, relating to the mechanical transmission between the electromechanical actuator and the screen. The immobilization of the electromechanical actuator inside the rail is not detailed. Furthermore, the mounting of the elements of the motorized drive device inside the rail is complex.

SUMMARY OF THE INVENTION

The object of the present invention is to solve the above drawbacks and to propose a screening device, comprising a rail, a screen, a motorized drive device and an autonomous electrical power supply device, which allows to simplify the mounting of a battery module of the autonomous electrical power supply device and an electromechanical actuator of the motorized drive device inside the rail.

Also known is US 2017/0067286 A1, which describes a screening device comprising a rail, a screen, a drive shaft, a motorized drive device, and an autonomous electrical power supply device. The motorized drive device comprises an electromechanical actuator. The electromechanical actuator is arranged inside the rail, in an assembled configuration of the screening device. The electromechanical actuator is configured to drive the screen in motion by means of the drive shaft. The electromechanical actuator is electrically connected to the autonomous electrical power supply device. The electromechanical actuator comprises a first end and a second end, the second end being opposite the first end. The autonomous electrical power supply device comprises a battery module. The battery module is arranged inside the rail, in the assembled configuration of the screening device. The battery module comprises a first end and a second end, the second end being opposite the first end. The battery module comprises a battery. The electromechanical actuator comprises a mounting bracket and another mounting bracket. The mounting bracket is arranged at the first end of the electromechanical actuator, in the assembled configuration of the screening device. The other mounting bracket is arranged at the second end of the electromechanical actuator, in the assembled configuration of the screening device. Each of the mounting brackets of the electromechanical actuator is arranged inside the rail and configured to hold the electromechanical actuator inside the rail, in the assembled configuration of the screening device. Each of the mounting brackets of the electromechanical actuator comprises an opening. The opening in each of the mounting brackets is configured to accommodate the drive shaft, in the assembled configuration of the screening device.

To this end, according to a first aspect, the present invention is directed to a screening device, the screening device comprising at least:

- a rail,
- a screen,
- a drive shaft,
- a motorized drive device, and
- an autonomous electrical power supply device, the motorized drive device comprising at least:

- an electromechanical actuator, the electromechanical actuator being arranged inside the rail, in an assembled configuration of the screening device, the electromechanical actuator being configured to move the screen by means of the drive shaft, the electromechanical actuator being electrically connected to the autonomous electrical power supply device, the electromechanical actuator comprising a first end and a second end, the second end being opposite the first end, the autonomous electrical power supply device comprising at least:

- a battery module, the battery module being arranged inside the rail, in the assembled configuration of the screening device, the battery module comprising a first end and a second end, the second end being opposite the first end, the battery module comprising at least:

- a battery,
- a first mounting bracket, the first mounting bracket being arranged at the first end of the battery module, in the assembled configuration of the screening device, and a second mounting bracket, the second mounting bracket being arranged at the second end of the battery module, in the assembled configuration of the screening device, each of the first and second mounting brackets being arranged inside the rail and configured to hold the battery module inside the rail, in the assembled configuration of the screening device, the electromechanical actuator comprising at least:

a third mounting bracket, the third mounting bracket being arranged at the first end of the electromechanical actuator, in the assembled configuration of the screening device, and a fourth mounting bracket, the fourth mounting bracket being arranged at the second end of the electromechanical actuator, in the assembled configuration of the screening device.

Each of the third and fourth mounting brackets is arranged inside the rail and configured to hold the electromechanical actuator inside the rail, in the assembled configuration of the screening device. The first, second, third and fourth mounting brackets are identical. Furthermore, each of the first, second, third and fourth mounting brackets comprises an opening. The opening in each of the first, second, third and fourth mounting brackets is configured to accommodate the drive shaft, in the assembled configuration of the screening device.

Thus, such a construction of the screening device allows to simplify the assembly of the battery module and the electromechanical actuator inside the rail by means of identical first, second, third and fourth mounting brackets.

In this manner, the first, second, third and fourth mounting brackets are interchangeable and can thus allow the battery module and the electromechanical actuator to be mounted inside the rail, respectively.

The first, second, third and fourth mounting brackets are thus common mounting accessories of the battery module and the electromechanical actuator inside the rail.

Furthermore, the first, second, third and fourth mounting brackets are designed to have the drive shaft passing through them.

In this manner, the drive shaft can be rotated by the electromechanical actuator, about its axis of rotation, through the opening of each of the first, second, third and fourth mounting brackets, while avoiding impact with the first, second, third and fourth mounting brackets.

Moreover, the mounting, on the one hand, of the battery module and, on the other hand, of the electromechanical actuator inside the rail is implemented by means of the first, second, third and fourth mounting brackets, so as to accommodate different rail profiles and, more particularly, different geometries of the inner face of the rail.

In this manner, the mounting of the battery module and the electromechanical actuator inside the rail is implemented by selecting the first, second, third and fourth mounting brackets adapted to a rail profile and, more particularly, to a geometry of the inner face of the rail.

Such a construction of the screening device also allows to minimize a width of the rail, while dispensing with elements arranged outside the rail and ensuring an aesthetic appearance of the screening device.

Such a construction of the screening device allows the battery module and the electromechanical actuator to be housed inside the rail without protruding from the rail. Similarly, the first, second, third and fourth mounting brackets can be accommodated inside the rail without protruding from the rail.

According to an advantageous feature of the invention, the battery module further comprises a housing. The battery is arranged inside the housing, in an assembled configuration of the battery module.

According to another advantageous feature of the invention, the housing of the battery module comprises a recess. Furthermore, the recess of the housing is configured to accommodate the drive shaft, in the assembled configuration of the screening device.

According to another advantageous feature of the invention, the housing of the battery module comprises a first compartment and a second compartment. Furthermore, each of the first and second compartments of the housing houses at least one of the energy storage elements.

According to another advantageous feature of the invention, the recess of the housing of the battery module is provided between the first and second compartments of the housing.

According to another advantageous feature of the invention, the housing of the battery module presents a width less than the width of the rail. The electromechanical actuator further comprises a casing. Furthermore, the casing of the electromechanical actuator presents a width that is less than the width of the rail.

According to another advantageous feature of the invention, each of the first, second, third and fourth mounting brackets comprises at least a lower edge, an upper edge, and two side edges. Each of the first, second, third and fourth mounting brackets comprises a notch, at each of the side edges of the first, second, third and fourth mounting brackets. The rail comprises at least one lower wall and two side walls. The rail comprises a protruding portion at each of the side walls of the rail. Each protruding portion of the side walls of the rail faces towards the inside of the rail. Furthermore, in the assembled configuration of the screening device, each notch of one of the first, second, third and fourth mounting brackets is configured to cooperate with the protruding portion of one of the side walls of the rail, so as to secure each of the first, second, third and fourth mounting brackets inside the rail.

According to another advantageous feature of the invention, in the assembled configuration of the screening device, the first, second, third and fourth mounting brackets are attached to the battery module or the electromechanical actuator, respectively, by means of connecting elements.

According to another advantageous feature of the invention, in the assembled configuration of the screening device, the holding, on the one hand, of the battery module and, on the other hand, of the electromechanical actuator inside the rail is implemented by a pressure exerted by each of the first, second, third and fourth mounting brackets on an inner face of the rail.

According to another advantageous feature of the invention, the opening of each of the first, second, third and fourth mounting brackets comprises an open portion to an edge of these first, second, third and fourth mounting brackets. Furthermore, the open portion of the opening of each of the first, second, third and fourth mounting brackets is configured to insert the drive shaft towards the inside of the opening of these first, second, third and fourth mounting brackets, upon assembly of the screening device.

Further features and advantages of the invention will become apparent from the following description.

BRIEF DESCRIPTION OF THE DRAWINGS

In the appended drawings, given as non-limiting examples.

DESCRIPTION OF THE PREFERRED EMBODIMENTS

Figure 1:
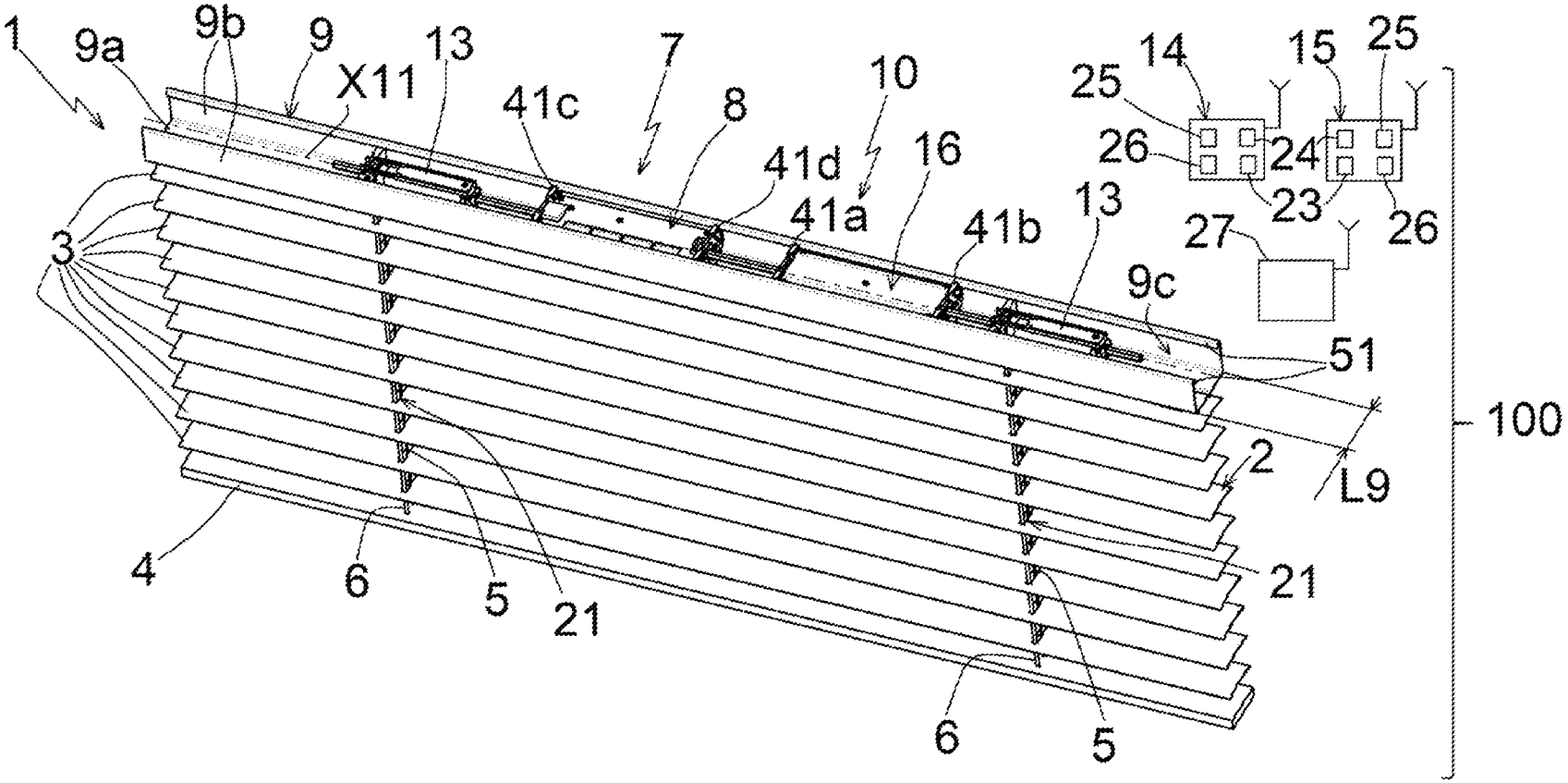
FIG. 1 is a schematic perspective view of a blind with adjustable slats according to a first embodiment of the invention.

First of all, with reference to FIG. 1, a home automation facility 100, according to a first embodiment of the invention, installed in a building, not shown, including an opening, window or door, equipped with a screen 2 belonging to a screening device 1, in particular a blind with slats, is described.

In a variant, not shown, the screening device 1 may be, in particular, a pleated blind.

The screening device 1 is, preferably, arranged inside the building.

In a variant, the screening device 1 is arranged outside the building.

With reference to FIG. 1, a blind with adjustable slats according to the first embodiment of the invention is described.

The screening device 1 comprises slats 3, in particular orientable slats. The screening device 1 may also comprise a load bar 4. Here, the screen 2 is formed by the slats 3 and the load bar 4. The load bar 4 is used to exert tension on the screen 2.

In practice, the load bar 4 is attached at a lower end of the screen 2, in an assembled configuration of the screening device 1 in the home automation facility 100.

In a variant, not shown, the screen 2 comprises an end slat in place of the load bar 4, which can be weighted.

The screening device 1 comprises drive cords 5 configured to allow vertical movement of the slats 3 and the load bar 4. The drive cords 5 may also be referred to as laces.

In practice, the slats 3 comprise respective openings 21 for passage of each drive cord 5.

In the example embodiment illustrated in FIG. 1, the screening device 1 further comprises orientation cords 6 configured to enable orientation of the slats 3. The orientation cords 6 are also called ladders.

Advantageously, in the assembled configuration of the screening device 1 in the home automation facility 100, each slat 3 of the screen 2 rests on a portion of the orientation cord 6, in particular horizontal and which may be referred to as a bar, connecting two strands of orientation cord 6, in particular vertical.

Thus, the orientation cords 6 allow to ensure that the slats 3 of the screen 2 are regularly spaced vertically.

The orientation of the slats 3 allows, in particular, to adjust the luminosity inside a room of the building.

When the screen 2 and, in particular, the load bar 4 are raised, the slats 3 are superimposed on the load bar 4, so as to form a stack.

In an example embodiment, not shown, the screening device 1 comprises two slides. Each of the slides is arranged along one side of the screen 2 of the screening device 1. The slides are configured to cooperate with the slats 3 of the screen 2, so as to guide the slats 3, when deploying and folding the screen 2.

In another example embodiment, also not shown, the guiding of the slats 3 is achieved by two cables. Each of the cables is arranged along a side of the screen 2 of the screening device 1.

The screening device 1 comprises a motorized drive device 7.

The motorized drive device 7 comprises an electromechanical actuator 8. The electromechanical actuator 8 allows to move the screen 2, in particular to lower or raise the slats 3 and the load bar 4, in other words to deploy or fold the screen 2, according to a vertical movement. The electromechanical actuator 8 further allows the slats 3 to be oriented.

The screening device 1 comprises a rail 9, inside which the motorized drive device 7 and, in particular, the electromechanical actuator 8 is arranged, in an assembled configuration of the screening device 1.

The rail 9 is arranged, in other words is configured to be arranged, above the screen 2, in the assembled configuration of the screening device 1.

Generally, the rail 9 is arranged above the opening of the building, or at the upper part of the opening of the building.

Advantageously, the rail 9 comprises a bottom wall 9*a* and two side walls 9*b*.

In the assembly mode illustrated in FIG. 1, the rail 9 has a "U" shaped cross-section.

The motorized drive device 7 comprises a plurality of reels. The reels are configured to wind and unwind the drive cords 5, so as to drive the vertical movement of the slats 3 and the load bar 4.

Here, the motorized drive device 7 comprises two reels, not visible in FIG. 1.

The number of reels is not limiting and may be different, in particular greater than two.

The drive cords 5 are connected, on the one hand, to the load bar 4 and, on the other hand, to the reels.

In practice, in the assembled configuration of the screening device 1 in the home automation facility 100, the lower end of each drive cord 5 is connected to the load bar 4 and the upper end of each drive cord 5 is connected to one of the reels.

Preferably, the reels are arranged inside the rail 9.

Advantageously, the motorized drive device 7 comprises tilting devices 13, generally referred to as "tilters". The reels are arranged respectively inside a tilter 13. For this reason, the reels are not visible in FIG. 1.

Furthermore, the tilters 13 are arranged, in other words are configured to be arranged, inside the rail 9, in the assembled configuration of the screening device 1.

In the example embodiment illustrated in FIG. 1, the motorized drive device 7 comprises two tilters 13.

The number of tilters is not limiting and may be different, in particular greater than two. In the case where the number of tilters is greater than or equal to two, the electromechanical actuator can be arranged between two of the tilters.

Here, the tilters 13 are arranged on either side of the electromechanical actuator 8. Preferably, each tilter 13 is arranged in the vicinity of a longitudinal end of the rail 9.

The tilters 13 are configured to rotate the orientation cords 6 by a limited angle of rotation value, so as to orient the slats 3.

Advantageously, the motorized drive device 7 is controlled by a command unit. The command unit may be, for example, a local command unit 14.

The local command unit 14 can be connected in a wired or wireless manner to a central command unit 15. The central command unit 15 controls the local command unit 14, and other similar local command units distributed throughout the building.

The motorized drive device 7 is, preferably, configured to execute commands for moving, in particular for raising or lowering and, eventually, for orienting the screen 2 of the screening device 1, which can be emitted, in particular, by the local command unit 14 or the central command unit 15.

The home automation facility 100 comprises either the local command unit 14, or the central command unit 15, or the local command unit 14 and the central command unit 15.

Figure 3:
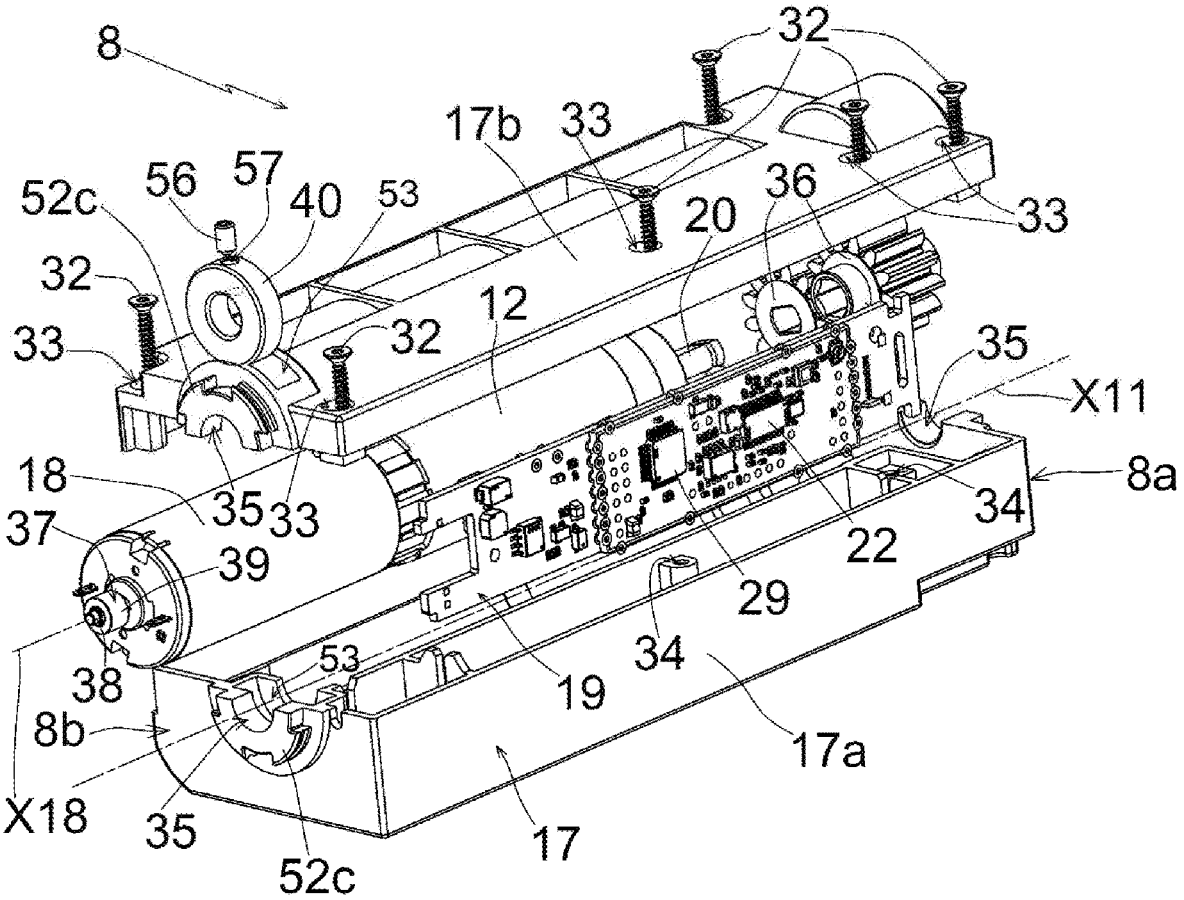
FIG. 3 is a schematic perspective and exploded view of the electromechanical actuator illustrated in FIG. 2, according to another viewing angle.

Means for controlling the electromechanical actuator 8, allowing the movement of the screen 2 of the screening device 1 as well as the orientation of the slats 3 of the screen 2, comprise at least a first electronic control unit 19, as illustrated in FIG. 3. This first electronic control unit 19 is able to operate an electric motor 18 of the electromechanical actuator 8 and, in particular, to allow the supply of electrical energy to the electric motor 18.

Thus, the first electronic control unit 19 controls, in particular, the electric motor 18, so as to open or close the screen 2, as well as to orient the slats 3 of the screen 2, as previously described.

Advantageously, the first electronic control unit 19 comprises at least one first communication module 22, in particular for receiving command orders, the command orders being emitted by a command transmitter, such as the local command unit 14 or central command unit 15, these orders being intended to control the motorized drive device 7.

Advantageously, the first communication module 22 of the first electronic control unit 19 is of the wireless type. In particular, the first communication module 22 is configured to receive radio command orders.

Advantageously, the first communication module 22 may also allow the reception of command orders transmitted by wired means.

Advantageously, the first electronic control unit 19, the local command unit 14 and/or the central command unit 15 can be in communication with a weather station, not shown, located inside the building or remotely outside the building, including, in particular, one or more sensors that can be configured to determine, for example, a temperature, a luminosity or a wind speed, in the case where the weather station is outside the building.

The first electronic control unit 19, the local command unit 14 and/or the central command unit 15 can also be in communication with a server 27, so as to control the electromechanical actuator 8 depending on data made available remotely by means of a communication network, in particular an internet network that can be connected to the server 27.

The first electronic control unit 19 can be controlled from the local command unit 14 or central command unit 15. The local command unit 14 or central command unit 15 is provided with a control keyboard. The control keyboard of the local command unit 14 or central command unit 15 comprises one or more selection elements 24 and, eventually, one or more display elements 25.

As non-limiting examples, the selection elements can be push buttons or touch-sensitive keys, and the display elements can be light-emitting diodes, an LCD (Liquid Crystal Display) or a TFT (Thin Film Transistor) display. The selection and display elements can also be realized by means of a touch screen.

Advantageously, the local command unit 14 or central command unit 15 comprises at least one second communication module 23.

Thus, the second communication module 23 of the local command unit 14 or central command unit 15 is configured to transmit, in other words emit, command orders, in particular by wireless means, for example radio, or by wired means.

Furthermore, the second communication module 23 of the local command unit 14 or central command unit 15 may also be configured to receive, in other words receive, command orders, in particular via the same means.

The second communication module 23 of the local command unit 14 or central command unit 15 is configured to communicate, in other words communicate, with the first communication module 22 of the first electronic control unit 19.

Thus, the second communication module 23 of the local command unit 14 or central command unit 15 exchanges command orders with the first communication module 22 of the first electronic control unit 19, either one-way or two-way.

Advantageously, the local command unit 14 is a control point, which may be fixed or nomadic. A fixed control point can be a control box intended to be fixed on a facade of a building wall or on a face of the frame of a window or a door. A nomadic control point may be a remote control, a smartphone or a tablet.

Advantageously, the local command unit 14 or central command unit 15 further comprises a controller 26.

The control means of the electromechanical actuator 8 comprises hardware and/or software means.

As a non-limiting example, the hardware means may comprise at least one microcontroller 29, as illustrated in FIG. 3.

The motorized drive device 7, in particular the first electronic control unit 19, is, preferably, configured to execute command orders for movement, in particular for deploying or folding the screen 2 of the screening device 1, as well as for orienting the slats 3. These command orders may be emitted, in particular, by the local command unit 14 or by the central command unit 15.

The motorized drive device 7 can be controlled by the user, for example by receiving a command order corresponding to a press on the or one of the selection elements 24 of the local command unit 14 or central command unit 15.

The motorized drive device 7 may also be controlled automatically, for example by receiving a command order corresponding to at least one signal from at least one sensor, not shown, and/or a signal from a clock, not shown, of the first electronic control unit 19, in particular the microcontroller 29. The sensor and/or the clock may be integrated in the local command unit 14 or in the central command unit 15.

The motorized drive device 7, including the electromechanical actuator 8, and the autonomous electrical power supply device 10, including a battery module 16, belonging to the screening device 1 of FIG. 1 are now described, in more detail with reference to FIGS. 2 to 6.

Figure 2:
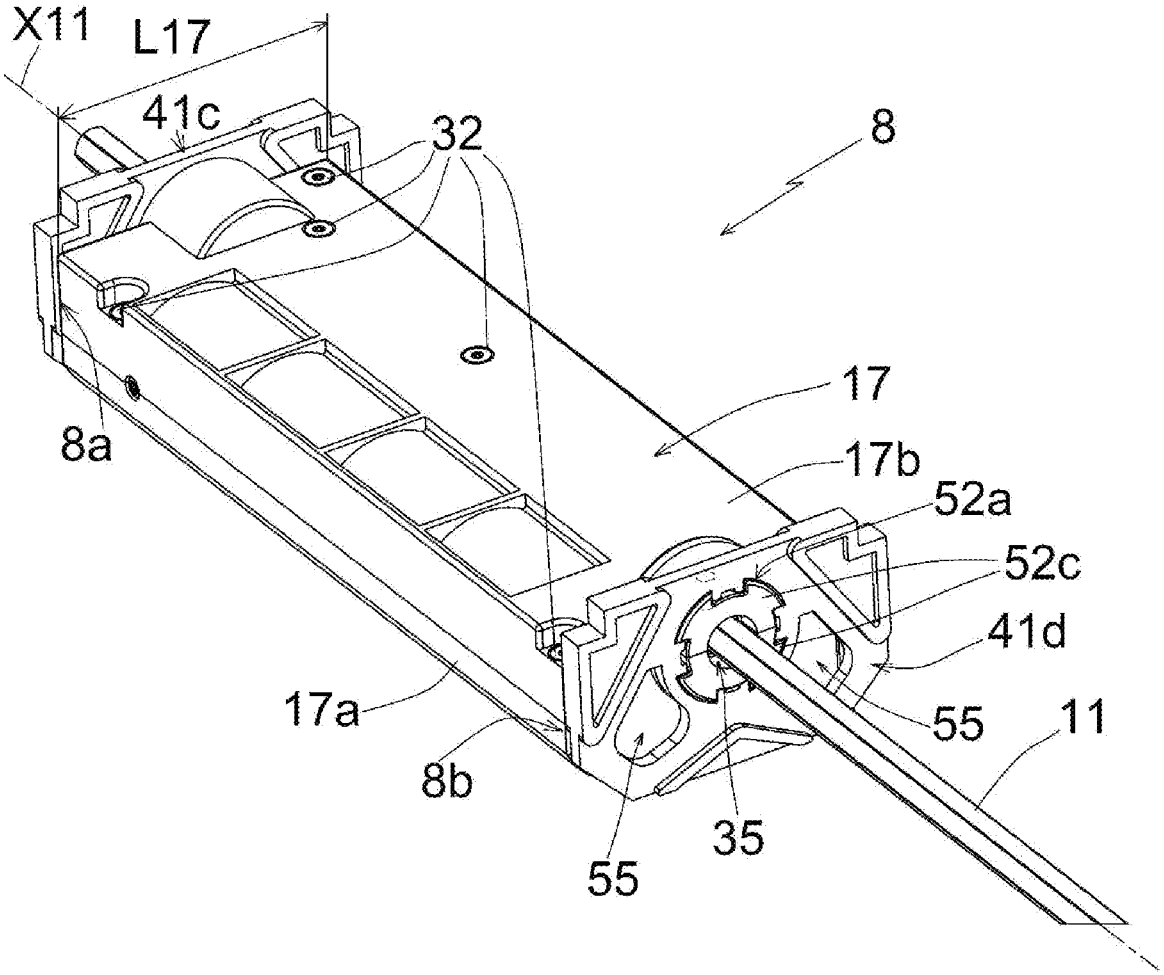
FIG. 2 is a schematic perspective view of an electromechanical actuator of the blind with adjustable slats illustrated in FIG. 1.

The electromechanical actuator 8 comprises a first end 8*a* and a second end 8*b*, as illustrated in FIGS. 2 and 3. The second end 8*b* is opposite the first end 8*a*.

Advantageously, the electromechanical actuator 8 further comprises the electric motor 18.

The electric motor 18 comprises a rotor 38 and a stator, not shown, positioned coaxially around a rotation axis X18.

The screening device 1 comprises an autonomous electrical power supply device 10, in that it allows the electromechanical actuator 8 to be powered, without itself being connected to the mains. The electromechanical actuator 8 is electrically connected to the autonomous electrical power supply device 10.

The autonomous electrical power supply device 10 comprises at least one battery module 16. The battery module 16 is arranged inside the rail 9, in the assembled configuration of the screening device 1. The battery module 16 comprises at least one battery 30.

Figure 4:
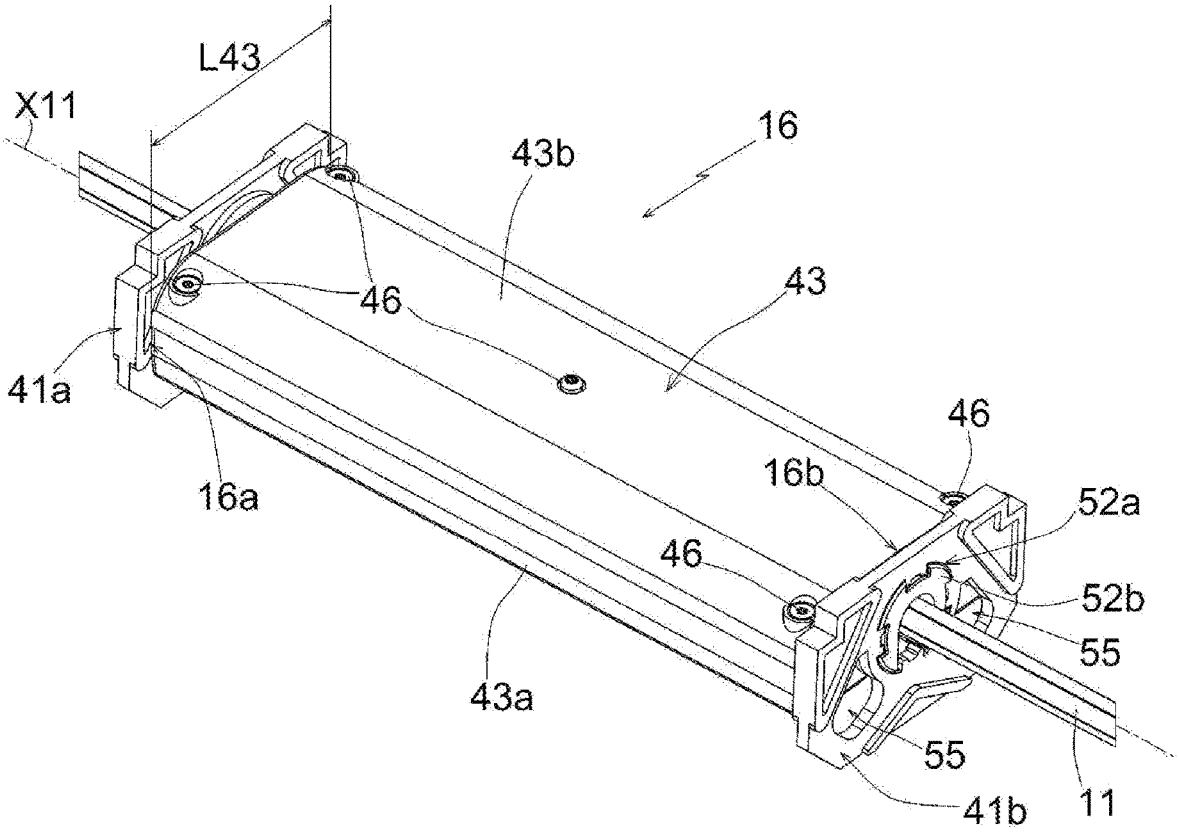
FIG. 4 is a schematic perspective view of a battery module of the blind with adjustable slats illustrated in FIG. 1.
Figure 5:
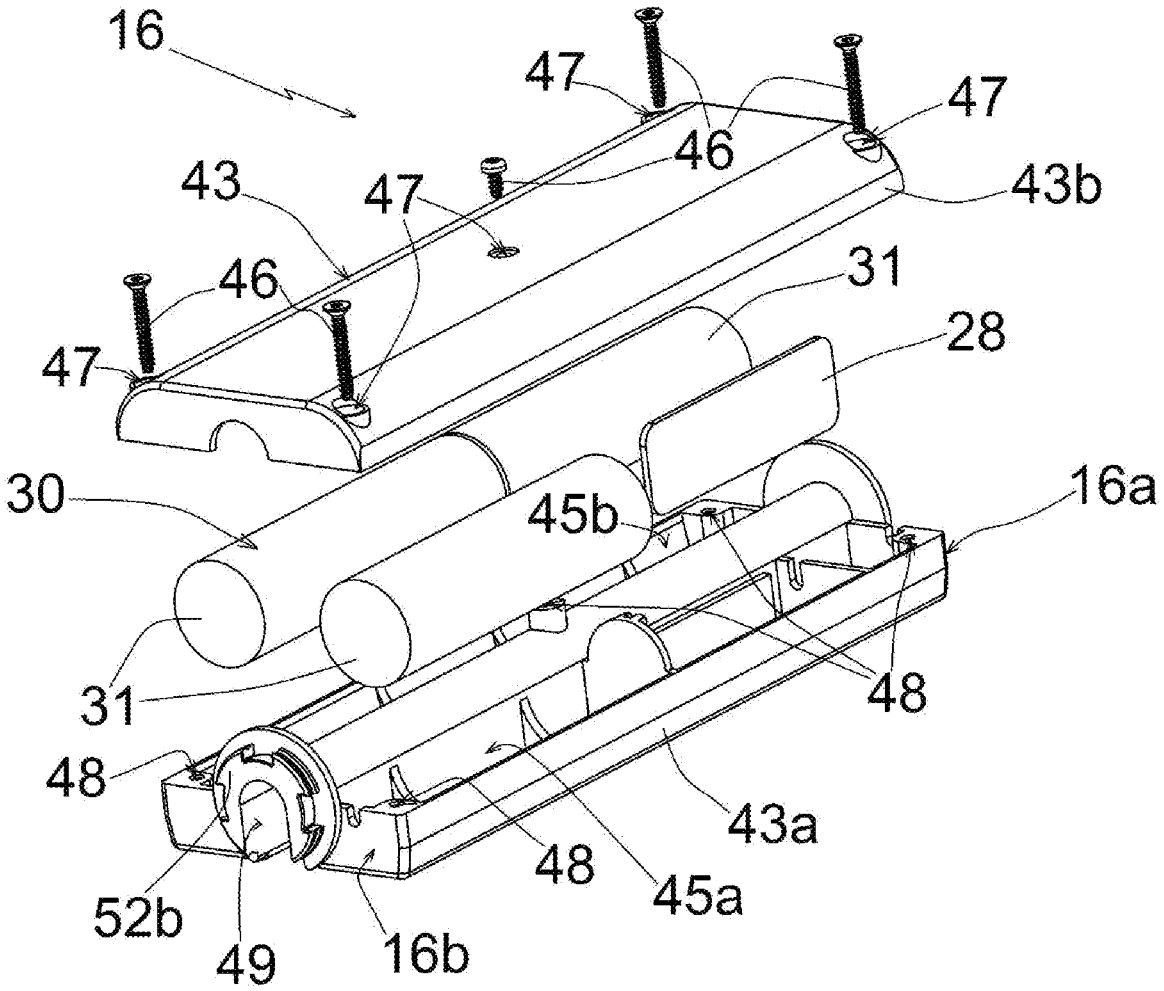
FIG. 5 is a schematic perspective and exploded view of the battery module illustrated in FIG. 4, according to another viewing angle.

The battery module 16 comprises a first end 16*a* and a second end 16*b*, as illustrated in FIGS. 4 and 5. The second end 16*b* is opposite the first end 16*a*.

Here, the battery module 16 is electrically connected directly to the first electronic control unit 19 and, thus, to the electromechanical actuator 8, via an electrical power cable, not shown.

Advantageously, the battery 30 is of the rechargeable type and supplies the electromechanical actuator 8 with electrical energy.

Advantageously, the battery 30 comprises a plurality of energy storage elements 31, as illustrated in FIG. 5. The energy storage elements 31 of the battery 30 may, in particular, be rechargeable batteries.

Advantageously, the battery module 16 further comprises a second electronic control unit 28.

Advantageously, the autonomous electrical power supply device 10 and, in particular, the second electronic control unit 28 of the battery module 16 comprises charging elements, not shown, configured to charge, in other words charge, in an ad hoc manner, the battery 30 from the electrical energy supplied by an external electrical power source, not shown, which may be, for example, a photovoltaic panel, an auxiliary battery, or a mains power supply, in particular when the battery 30 is insufficiently recharged by the photovoltaic panel or the auxiliary battery. The photovoltaic panel and/or the auxiliary battery are part of the autonomous electrical power supply device 10.

Advantageously, the electromechanical actuator 8 further comprises at least one gearbox 12 and at least one output shaft 20, as illustrated in FIG. 3.

The gearbox 12 comprises at least one reduction stage. The reduction stage may be an epicyclic type gear train.

The type and number of reduction stages of the gearbox are not limiting. The number of reduction stages may be, for example, two or three.

Here and as illustrated in FIG. 3, the electromechanical actuator 8 comprises a single gearbox 12 and a single output shaft 20.

Advantageously, the electromechanical actuator 8 also comprises a brake, not shown.

As non-limiting examples, the brake may be a magnetic brake, a spring brake, a cam brake or an electromagnetic brake.

Advantageously, the electromechanical actuator 8 further comprises a casing 17.

Advantageously, the casing 17 of the electromechanical actuator 8 comprises a base 17*a* and a cover 17*b*.

Advantageously, in an assembled configuration of the electromechanical actuator 8, the electric motor 18, the gearbox 12 and, eventually, the brake are arranged inside the casing 17 of the electromechanical actuator 8 and, more particularly, between the base 17*a* and the cover 17*b*.

Here and as illustrated in FIG. 3, the first electronic control unit 19 is arranged inside the casing 17 of the electromechanical actuator 8 and, more particularly, between the base 17*a* and the cover 17*b*, in the assembled configuration of the electromechanical actuator 8.

Here, the casing 17 of the electromechanical actuator 8 is made of two half-shells, forming respectively the base 17*a* and the cover 17*b*.

Advantageously, in the assembled configuration of the electromechanical actuator 8, the cover 17*b* is fixed to the base 17*a* by means of fastening elements 32.

Thus, the cover 17*b* is integral with the base 17*a*, in the assembled configuration of the electromechanical actuator 8.

Here, the fastening elements 32 of the cover 17*b* with the base 17*a* are fastening screws, in particular six in number.

The number and type of fastening elements of the cover with the base are not limiting and may be different. The fastening elements may be, for example, elastic snap-in fastening elements and two or more in number.

Here, in the assembled configuration of the electromechanical actuator 8, the fastening screws 32 pass through holes 33 provided in the cover 17*b* of the casing 17 and are screwed into threaded recesses 34 in the base 17*a* of the casing 17.

In a variant, not shown, in the assembled configuration of the electromechanical actuator 8, the fastening screws 32 pass through holes provided in the base 17*a* of the casing 17 and are screwed into threaded recesses provided in the cover 17*b* of the casing 17.

Advantageously, the casing 17 of the electromechanical actuator 8 is made of a plastic material.

The screening device 1 further comprises a drive shaft 11.

The electromechanical actuator 8 is configured to drive, in other words drive, by displacing the screen 2 by means of the drive shaft 11.

Thus, the drive shaft 11 is coupled with the electromechanical actuator 8, so as to displace the screen 2, in particular, on the one hand, by raising or lowering the slats 3 of the screen 2 and, on the other hand, by tilting the slats 3 of the screen 2.

Here, in the assembled configuration of the screening device 1, the drive shaft 11 extends inside the rail 9, along a longitudinal direction of the rail 9.

Here and as illustrated in FIG. 2, in the assembled configuration of the screening device 1, the electromechanical actuator 8 and, more particularly, the casing 17, is configured to be traversed, in other words is traversed, by the drive shaft 11, in particular through orifices 35 provided in the casing 17 and, more particularly, in the base 17*a* and the cover 17*b* of the casing 17, only one of which is visible in FIG. 2. An orifice 35 is provided at each of the first and second ends of the casing 17, which correspond to the first and second ends 8*a*, 8*b* respectively of the electromechanical actuator 8.

Advantageously, the output shaft 20 of the electromechanical actuator 8 is connected to the drive shaft 11 by means of a gear and, more particularly, pinions 36, in particular two in number, as illustrated in FIG. 3, where the drive shaft 11 is represented by its axis of rotation X11.

The number of pinions connecting the output shaft of the electromechanical actuator to the drive shaft is not limiting and may be different. It may be, for example, three or more.

Here and as illustrated in FIGS. 2 and 3, the electric motor 18, the gearbox 12, the output shaft 20 and, eventually, the brake are mounted parallel to the drive shaft 11, in the assembled configuration of the screening device 1. In other words, the rotational axis X18 of the electric motor 18, which is also the rotational axis of the gearbox 12, the output shaft 20 and, eventually, the brake, is parallel to, and laterally offset from, the rotational axis X11 of the drive shaft 11, which is also the rotational axis of the tilters 13, in the assembled configuration of the screening device 1.

Advantageously, the electromechanical actuator 8 may further comprise a switching device, not shown.

In the case of a blind with slats, a high position, in particular a safety position, corresponds to a pressing of a first slat 3 of the screen 2 against an element of the switching device.

The first slat 3 of the screen 2 corresponds to the upper slat 3 of the screen 2, in the assembled configuration of the screening device 1 in the home automation facility 100.

In particular, the switching device is able to determine when the upper position of the screen 2 has been reached.

Advantageously, the electromechanical actuator 8 further comprises a counting device 37, which may also be referred to as a limit and/or obstacle detection device.

Here and as illustrated in FIG. 3, the counting device 37 is of magnetic type and arranged around the rotor 38 of the electric motor 18, inside the electromechanical actuator 8 and, more particularly, the casing 17, in particular between the base 17*a* and the cover 17*b* of the casing 17.

Such a counting device 37 may, for example, comprise a magnetic wheel 39, in particular mounted on the rotor 38, and one or more Hall effect sensors, not shown.

The type of counting device is not limiting and may be different. The counting device may, in particular, comprise a magnetic ring, configured to form a plurality of position detection sensors, replacing the Hall effect sensor(s). It may be arranged on the output shaft of the electromechanical actuator instead of on the rotor of the electric motor. It can also be, for example, of optical type or of time type and realized through the microcontroller of the first electronic control unit.

An upper end-of-travel position, in particular operating position, corresponds to a predetermined upper end-of-travel position, in particular, by means of the counting device 37.

Furthermore, a lower end-of-travel position corresponds to a predetermined lower end-of-travel position, in particular, by means of the counting device 37, or to the bearing of the load bar 4 against a threshold of the opening of the building, or to the complete deployment of the screen 2.

Advantageously, the electromechanical actuator 8 further comprises a ring 40. The ring 40 is mounted in a housing 53 of the casing 17. Here, the housing 53 is formed in both the base 17*a* and the cover 17*b* of the casing 17. In the assembled configuration of the screening device 1, the ring 40 is arranged around the drive shaft 11. Furthermore, the ring 40 allows to hold the drive shaft 11 in position inside the casing 17.

Thus, the ring 40 serves as a bearing, so as to ensure the assembly and rotational drive of the drive shaft 11 relative to the electromechanical actuator 8 and, more particularly, inside the rail 9, in the assembled configuration of the screening device 1.

Advantageously, the ring 40 is held in position relative to the drive shaft 11 by means of at least one clamping element, for example a set screw 56.

Here, in the assembled configuration of the screening device 1, the set screw 56 is screwed into a threaded hole 57 provided in the ring 40 and brought to bear against the drive shaft 11.

The battery module 16 comprises a first mounting bracket 41*a* and a second mounting bracket 41*b*. In the assembled configuration of the screening device 1, the first mounting bracket 41*a* is arranged at the first end 16*a* of the battery module 16. Furthermore, in the assembled configuration of the screening device 1, the second mounting bracket 41*b* is arranged at the second end 16*b* of the battery module 16.

Each of the first and second mounting brackets 41*a*, 41*b* is arranged inside the rail 9 and configured to hold, in other words holds, the battery module 16 inside the rail 9, in the assembled configuration of the screening device 1.

The electromechanical actuator 8 comprises a third mounting bracket 41*c* and a fourth mounting bracket 41*d*. In the assembled configuration of the screening device 1, the third mounting bracket 41*c* is arranged at the first end 8*a* of the electromechanical actuator 8. Furthermore, in the assembled configuration of the screening device 1, the fourth mounting bracket 41*d* is arranged at the second end 8*b* of the electromechanical actuator 8.

Each of the third and fourth mounting brackets 41*c*, 41*d* is arranged inside the rail 9 and configured to hold, in other words holds, the electromechanical actuator 8 inside the rail 9, in the assembled configuration of the screening device 1.

The first, second, third and fourth mounting brackets 41*a*, 41*b*, 41*c*, 41*d* are identical.

Furthermore, each of the first, second, third and fourth mounting brackets 41*a*, 41*b*, 41*c*, 41*d* comprises an opening 42. The opening 42 of each of the first, second, third and fourth mounting brackets 41*a*, 41*b*, 41*c*, 41*d* is configured to accommodate, in other words holds, the drive shaft 11, in the assembled configuration of the screening device 1.

Thus, such a construction of the screening device 1 allows to simply the assembly of the battery module 16 and the electromechanical actuator 8 inside the rail 9 by means of identical first, second, third and fourth mounting brackets 41*a*, 41*b*, 41*c*, 41*d*.

In this manner, the first, second, third and fourth mounting brackets 41*a*, 41*b*, 41*c*, 41*d* are interchangeable and can thus allow the battery module 16 and the electromechanical actuator 8 to be mounted inside the rail 9, respectively.

The first, second, third and fourth mounting brackets 41*a*, 41*b*, 41*c*, 41*d* are thus common mounting accessories of the battery module 16 and the electromechanical actuator 8 inside the rail 9.

Furthermore, the first, second, third and fourth mounting brackets 41*a*, 41*b*, 41*c*, 41*d* are designed to have the drive shaft 11 passing through them.

In this manner, the drive shaft 11 can be rotated by the electromechanical actuator 8, around the axis of rotation X11, through the opening 42 of each of the first, second, third and fourth mounting brackets 41*a*, 41*b*, 41*c*, 41*d*, while avoiding impact with the first, second, third and fourth mounting brackets 41*a*, 41*b*, 41*c*, 41*d*.

Moreover, the mounting, on the one hand, of the battery module 16 and, on the other hand, of the electromechanical actuator 8 inside the rail 9 is implemented by means of the first, second, third and fourth mounting brackets 41*a*, 41*b*, 41*c*, 41*d*, so as to adapt to different profiles of the rail 9 and, more particularly, to different geometries of the inner face 9*c* of the rail 9.

In this manner, the mounting of the battery module 16 and the electromechanical actuator 8 inside the rail 9 is implemented by selecting the first, second, third and fourth mounting brackets 41*a*, 41*b*, 41*c*, 41*d* adapted to a profile of the rail 9 and, more particularly, to a geometry of the inner face 9*c* of the rail 9.

Such a construction of the screening device 1 also allows to minimize a width L9 of the rail 9, while avoiding elements arranged outside the rail 9 and ensuring an aesthetic appearance of the screening device 1.

Such a construction of the screening device 1 allows the battery module 16 and the electromechanical actuator 8 to be accommodated inside the rail 9 without protruding from the rail 9. Similarly, the first, second, third and fourth mounting brackets 41*a*, 41*b*, 41*c*, 41*d* can be accommodated inside the rail 9 without protruding from the rail 9.

Advantageously, the opening 42 of each of the first, second, third and fourth mounting brackets 41*a*, 41*b*, 41*c*, 41*d* is arranged in the central portion thereof.

Figure 6:
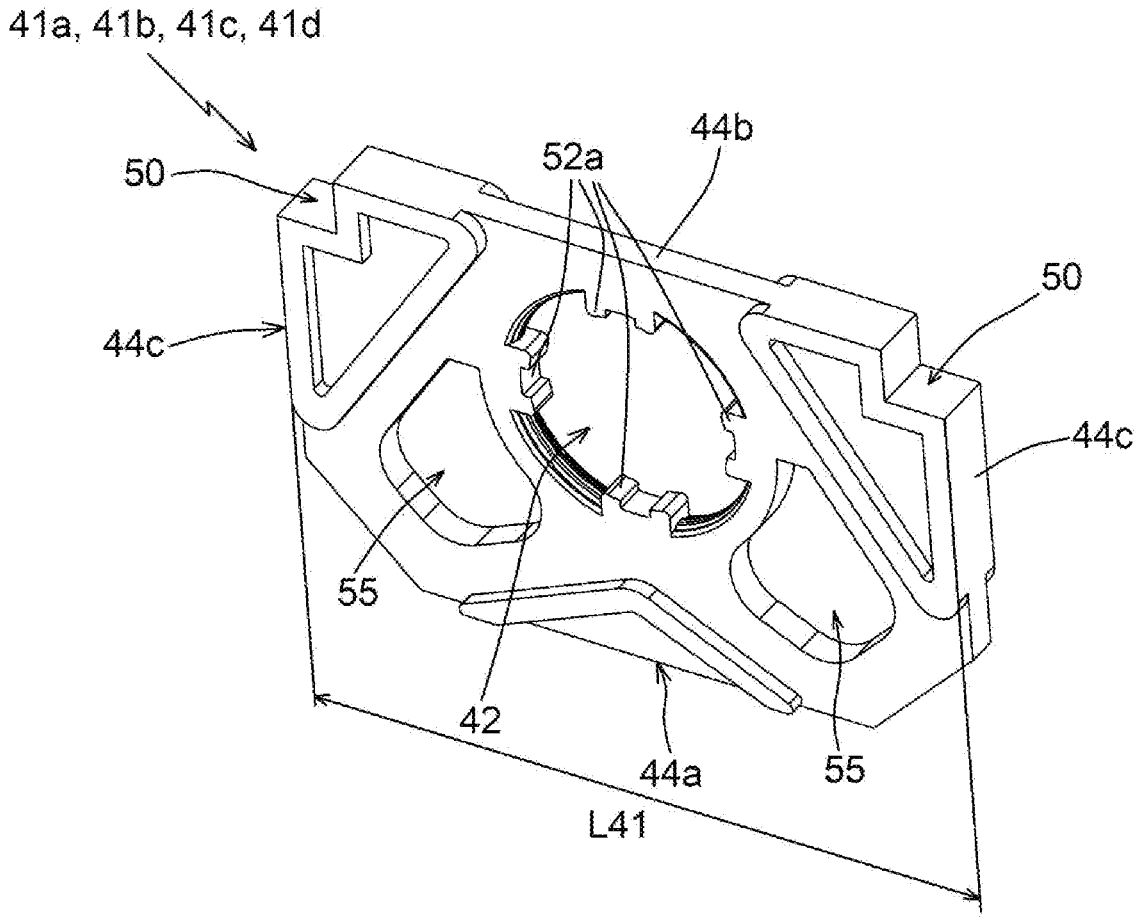
FIG. 6 is a schematic perspective view of one of the mounting brackets of the blind with adjustable slats illustrated in FIG. 1, according to the first embodiment.

Advantageously, as seen for example in FIG. 6, each of the first, second, third and fourth mounting brackets 41*a*, 41*b*, 41*c*, 41*d* comprises at least a lower edge 44*a*, an upper edge 44*b* and two side edges 44*c*.

Advantageously, the battery module 16 further comprises a housing 43. The battery 30 is arranged inside the housing 43, in an assembled configuration of the battery module 16.

Advantageously, the housing 43 of the battery module 16 comprises a first end and a second end. Here, the second end of the housing 43, corresponding to the second end 16*b* of the battery module 16, is opposite the first end of the housing 43, corresponding to the first end 16*a* of the battery module 16. The first mounting bracket 41*a* is arranged at the first end of the housing 43. Furthermore, the second mounting bracket 41*b* is arranged at the second end of the housing 43.

Thus, such a construction of the screening device 1 allows to simply the assembly of the battery module 16 inside the rail 9 by means of the identical first and second mounting brackets 41*a*, 41*b*.

Furthermore, the housing 43 of the battery module 16 is universal, in other words compatible with different rail profiles 9 and, more particularly, different geometries of the inner face 9*c* of the rail 9.

Advantageously, and as mentioned above, the casing 17 of the electromechanical actuator 8 comprises a first end and a second end. Here, the second end of the casing 17, corresponding to the second end 8*b* of the electromechanical actuator 8, is opposite the first end of the casing 17, corresponding to the first end 8*a* of the electromechanical actuator 8. The third mounting bracket 41*c* is arranged at the first end of the casing 17. Furthermore, the fourth mounting bracket 41*d* is arranged at the second end of the casing 17.

Thus, such a construction of the screening device 1 allows to simplify the assembly of the electromechanical actuator 8 inside the rail 9 by means of the identical third and fourth mounting brackets 41*c*, 41*d*.

Furthermore, the casing 17 of the electromechanical actuator 8 is universal, in other words compatible with different profiles of the rail 9 and, more particularly, different geometries of the inner face 9*c* of the rail 9.

Advantageously, the housing 43 of the battery module 16 comprises a base 43*a* and a cover 43*b*.

Advantageously, the energy storage elements 31 of the battery 30 are arranged inside the housing 43 of the battery module 16 and, more particularly, between the base 43*a* and the cover 43*b*, in the assembled configuration of the battery module 16.

Here, the housing 43 of the battery module 16 is made of two half-shells, forming the base 43*a* and the cover 43*b*, respectively.

Advantageously, the cover 43*b* is fixed to the base 43*a* by means of fastening elements, in the assembled configuration of the battery module 16.

Thus, the cover 43*b* is integral with the base 43*a*, in the assembled configuration of the battery module 16.

Here, the fastening elements of the cover 43*b* with the base 43*a* are fastening screws 46, in particular five in number.

The number and type of fastening elements of the cover with the base are not limiting and may be different. The fastening elements may be, for example, elastic snap-in fastening elements and two or more in number.

Here, in the assembled configuration of the battery module 16, the fastening screws 46 pass through holes 47 provided in the cover 43*b* of the housing 43 and are screwed into threaded recesses 48 provided in the base 43*a* of the housing 43.

In a variant, not shown, in the assembled configuration of the battery module 16, the fastening screws 46 pass through holes provided in the base 43*a* of the housing 43 and are screwed into threaded recesses provided in the cover 43*b* of the housing 43.

Advantageously, the housing 43 of the battery module 16 is made from a plastic material.

Advantageously, the housing 43 of the battery module 16 comprises a recess 49, as illustrated in FIG. 5. Furthermore, the recess 49 of the housing 43 is configured to accommodate, in other words accommodates, the drive shaft 11, in the assembled configuration of the screening device 1.

Thus, the housing 43 of the battery module 16 is designed to be arranged partially around the drive shaft 11 by means of the recess 49 of this battery module 16.

Here, the recess 49 of the housing 43 is realized as a concave area formed in the housing 43 and extending along a longitudinal direction of the housing 43.

Here, in the assembled configuration of the screening device 1, the drive shaft 11 of the screening device 1 extends through the opening 42 of each of the first, second, third and fourth mounting brackets 41*a*, 41*b*, 41*c*, 41*d* and the recess 49 of the housing 43 of the battery module 16.

Here, the first and second mounting brackets 41*a*, 41*b* are configured to be assembled, in other words are assembled, inside the rail 9 prior to assembling the battery module 16 on the first and second mounting brackets 41*a*, 41*b* and positioning the drive shaft 11 inside the recess 49 of the housing 43 of the battery module 16.

In this manner, the battery module 16 can be mounted and removed relative to the rail 9, without the first and second mounting brackets 41*a*, 41*b* being integral with the battery module 16 and while maintaining the drive shaft 11 in position inside the rail 9, in particular when replacing the battery 30 of the battery module 16.

Advantageously, the drive shaft 11 is inserted inside the opening 42 of each of the first and second mounting brackets 41*a*, 41*b* prior to or upon assembly of the first and second mounting brackets 41*a*, 41*b* inside the rail 9.

Advantageously, the housing 43 of the battery module 16 comprises a first compartment 45*a* and a second compartment 45*b*. Furthermore, each of the first and second compartments 45*a*, 45*b* of the housing 43 houses at least one of the energy storage elements 31.

Advantageously, in the assembled configuration of the screening device 1, the first and second compartments 45*a*, 45*b* of the housing 43 extend inside the rail 9, along the longitudinal direction of the rail 9.

Advantageously, the first and second compartments 45*a*, 45*b* of the housing 43 are parallel to each other.

Here, the first and second compartments 45*a*, 45*b* of the housing 43 have a circular cross-section.

The shape of the cross-section of the first and second housing compartments is not limiting and may be different, in particular depending on the shape of the energy storage elements of the battery. It may be, for example, square or rectangular.

Advantageously, the cover 43*b* and the base 43*a* are designed to form together the first and second compartments 45*a*, 45*b* of the housing 43 of the battery module 16.

Advantageously, the recess 49 of the housing 43 of the battery module 16 is provided between the first and second compartments 45*a*, 45*b* of the housing 43, along a direction perpendicular to the axis of rotation X11.

Thus, the drive shaft 11 can be rotated by the electromechanical actuator 8, around the axis of rotation X11, through the recess 49 of the housing 43, while avoiding impact with the housing 43 of the battery module 16.

Advantageously, in the assembled configuration of the screening device 1, the holding, on the one hand, of the battery module 16 and, on the other hand, of the electromechanical actuator 8 inside the rail 9 is implemented by a pressure exerted by each of the first, second, third and fourth mounting brackets 41*a*, 41*b*, 41*c*, 41*d* on the inner face 9*c* of the rail 9.

Advantageously, the housing 43 of the battery module 16 presents a width L43 less than the width L9 of the rail 9 and, in particular, less than a width L41 of each of the first, second, third and fourth mounting brackets 41*a*, 41*b*, 41*c*, 41*d*. Furthermore, the casing 17 of the electromechanical actuator 8 presents a width L17 that is less than the width L9 of the rail 9 and, in particular, less than the width L41 of each of the first, second, third and fourth mounting brackets 41*a*, 41*b*, 41*c*, 41*d*.

Advantageously, in the assembled configuration of the screening device 1, the lower edge 44*a* of each of the first, second, third and fourth mounting brackets 41*a*, 41*b*, 41*c*, 41*d* abuts against the bottom wall 9*a* of the rail 9. Furthermore, each of the side edges 44*c* of each of the first, second, third and fourth mounting brackets 41*a*, 41*b*, 41*c*, 41*d* abuts against one of the side walls 9*b* of the rail 9.

Advantageously, each of the first, second, third and fourth mounting brackets 41*a*, 41*b*, 41*c*, 41*d* comprises a notch 50, at each of its side edges 44*c*. The rail 9 comprises a protruding portion 51 at each of the side walls 9*b* of the rail 9. Each protruding portion 51 of the side walls 9*b* of the rail 9 faces towards the inside of the rail 9. Furthermore, in the assembled configuration of the screening device 1, each notch 50 of one of the first, second, third and fourth mounting brackets 41*a*, 41*b*, 41*c*, 41*d* is configured to cooperate, in other words cooperates, with the protruding portion 51 of one of the side walls 9*b* of the rail 9, so as to immobilize each of the first, second, third and fourth mounting brackets 41*a*, 41*b*, 41*c*, 41*d* inside the rail 9.

Here, the protruding portion 51 of each of the side walls 9*b* of the rail 9 is obtained by bending one end of one of the side walls 9*b* of the rail 9 toward the inside of the rail 9 and, more particularly, towards the bottom wall 9*a* of the rail 9, so as to form a bead.

In a variant, not shown, the protruding portion 51 of each of the side walls 9*b* of the rail 9 is obtained by a deformation of another type of the one side wall 9*b* of the rail 9 towards the inside of the rail 9, for example by stamping in the case where the rail 9 is made of metallic material.

Advantageously, in the assembled configuration of the screening device 1, the first, second, third and fourth mounting brackets 41*a*, 41*b*, 41*c*, 41*d* are attached respectively to the battery module 16, in particular to the housing 43 of the battery module 16, or to the electromechanical actuator 8, in particular to the casing 17 of the electromechanical actuator 8, by means of connecting elements 52*a*, 52*b*, 52*c*, in other words fastening or securing elements.

Here, the assembly elements 52*a* of each of the first, second, third and fourth mounting brackets 41*a*, 41*b*, 41*c*, 41*d* are arranged around the opening 42 of these first, second, third and fourth mounting brackets 41*a*, 41*b*, 41*c*, 41*d*. Furthermore, the assembly elements 52*a* of each of the first, second, third and fourth mounting brackets 41*a*, 41*b*, 41*c*, 41*d* are identical.

Here in a non-limitative way, the assembly elements 52*b* of the housing 43 of the battery module 16 are provided only in the base 43*a*. Furthermore, the assembly elements 52*c* of the casing 17 of the electromechanical actuator 8 are arranged, on the one hand, in the base 17*a* and, on the other hand, in the cover 17*b*.

Advantageously, the assembly elements 52*b* of the battery module 16 and the assembly elements 52*c* of the electromechanical actuator 8 are identical.

Advantageously, the assembly elements 52*b* of the battery module 16 and the assembly elements 52*c* of the electromechanical actuator 8 are complementary to the assembly elements 52*a* of each of the first, second, third and fourth mounting brackets 41*a*, 41*b*, 41*c*, 41*d*, in particular with respect to their respective shapes.

Thus, the assembly elements 52*b* of the battery module 16 and the assembly elements 52*c* of the electromechanical actuator 8 are configured to cooperate, in other words cooperate, with the assembly elements 52*a* of each of the first, second, third and fourth mounting brackets 41*a*, 41*b*, 41*c*, 41*d*, in the assembled configuration of the screening device 1.

Here, the assembly elements 52*a*, 52*b*, 52*c* are interlocking connecting elements.

In a variant, not shown, the assembly elements 52*a*, 52*b*, 52*c* are snap-fit connecting elements.

Advantageously, each of the first, second, third and fourth mounting brackets 41*a*, 41*b*, 41*c*, 41*d* further comprises at least one cutout 55, in other words an opening.

Here and as illustrated in FIGS. 2, 4 and 6, each of the first, second, third and fourth mounting brackets 41*a*, 41*b*, 41*c*, 41*d* comprises two cutouts 55.

Advantageously, the two cutouts 55 are arranged on opposite sides of the opening 42 of each of the first, second, third and fourth mounting brackets 41*a*, 41*b*, 41*c*, 41*d*, such that the first, second, third and fourth mounting brackets 41*a*, 41*b*, 41*c*, 41*d* are symmetrical relative to the opening 42.

The number and shape of the cutouts are not limiting and may be different. The cutouts may be, for example, one, three or more in number. They may also be, for example, circular.

Advantageously, the or each cutout 55 of each of the first, second, third and fourth mounting brackets 41*a*, 41*b*, 41*c*, 41*d* is configured to allow one or more power supply cables, not shown, to pass inside the rail 9, in the assembled configuration of the screening device 1, these cables may be, for example, a power supply cable electrically connecting the electromechanical actuator 8 to the battery module 16 and/or a power supply cable electrically connecting the battery module 16 with the external power source.

Thus, the power supply cable(s) are housed inside the rail 9 without protruding outside of the rail 9, following their electrical connection to the members of the motorized drive device 7 and the autonomous electrical power supply device 10.

Advantageously, the rail 9 may comprise an electrical connector, not shown. Furthermore, the electrical connector is configured to electrically connect the battery module 16 to the external electrical power source.

Advantageously, the electrical connector is positioned in one of the walls 9*a*, 9*b* of the rail 9, this wall may be, for example, the bottom wall 9*a* or one of the side walls 9*b*.

Advantageously, the electrical connector is fixed to the rail 9 by means of elastic snap-in fixing elements.

Figure 7:
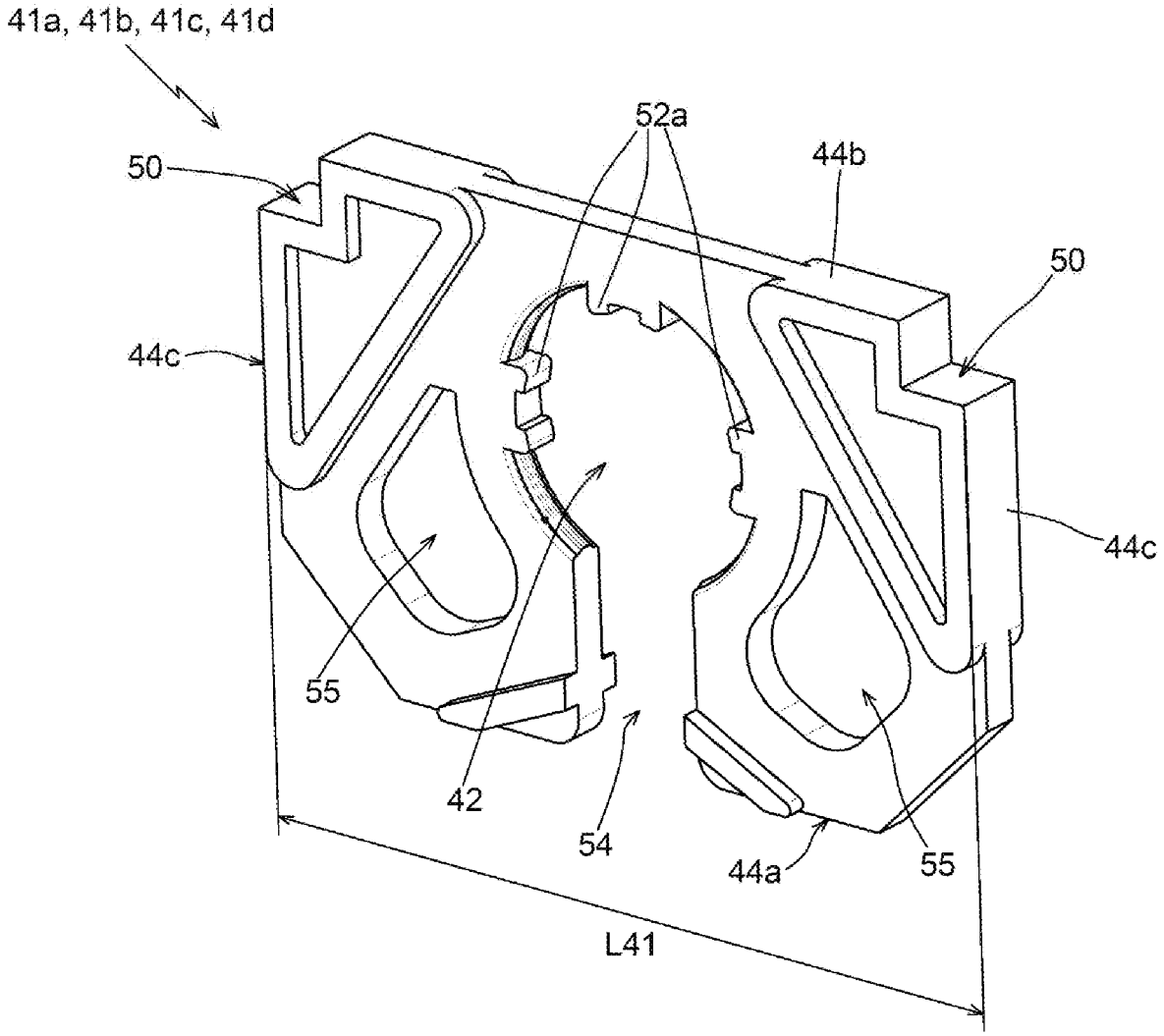
FIG. 7 is a schematic perspective view of one of the mounting brackets of a blind with adjustable slats according to a second embodiment of the invention.

In the second embodiment, shown in FIG. 7, the elements similar to those of the first embodiment have the same references and function as explained above. In what follows, is described, mainly, that which distinguishes this second embodiment from the previous one. In what follows, when a reference sign is used without being reproduced in FIG. 7, it corresponds to the object bearing the same reference in one of FIGS. 1 to 6.

Now, with reference to FIG. 7, the screening device 1 and, more particularly, the first, second, third and fourth mounting brackets 41*a*, 41*b*, 41*c*, 41*d* according to the second embodiment of the invention are described.

Here, the opening 42 of each of the first, second, third and fourth mounting brackets 41*a*, 41*b*, 41*c*, 41*d* comprises an open portion 54 to an edge 44*a* of these first, second, third and fourth mounting brackets 41*a*, 41*b*, 41*c*, 41*d*. Furthermore, the open portion 54 of the opening 42 of each of the first, second, third and fourth mounting brackets 41*a*, 41*b*, 41*c*, 41*d* is configured to insert the drive shaft 11 therein towards the inside of the opening 42 of these first, second, third and fourth mounting brackets 41*a*, 41*b*, 41*c*, 41*d*, upon assembly of the screening device 1.

Thus, the first, second, third and fourth mounting brackets 41*a*, 41*b*, 41*c*, 41*d* are designed to be arranged around the drive shaft 11 by means of the open portion 54 of the opening 42 of these first, second, third and fourth mounting brackets 41*a*, 41*b*, 41*c*, 41*d*.

In this manner, the open portion 54 of the opening 42 of each of the first, second, third and fourth mounting brackets 41*a*, 41*b*, 41*c*, 41*d* is formed as a slit, extending from an edge 44*a* to the opening 42 of these first, second, third and fourth mounting brackets 41*a*, 41*b*, 41*c*, 41*d*.

Furthermore, following assembly of the first and second mounting brackets 41*a*, 41*b* to the battery module 16, the subassembly thus formed is configured to be inserted, in other words is inserted, into the rail 9, during assembly of the screening device 1, by positioning the drive shaft 11, first, inside the open portion 54 of the opening 42 and then inside the opening 42 of each of the first and second mounting brackets 41*a*, 41*b* and, concomitantly, inside the recess 49 of the housing 43 of the battery module 16.

In this manner, the subassembly formed by the first and second mounting brackets 41*a*, 41*b* and the battery module 16 can be mounted and removed relative to the rail 9, while maintaining the first and second mounting brackets 41*a*, 41*b* integral with the battery module 16 and holding the drive shaft 11 in position inside the rail 9, in particular when replacing the battery 30 of the battery module 16.

Advantageously, the opening 42 of each of the first, second, third and fourth mounting brackets 41*a*, 41*b*, 41*c*, 41*d* opens, through the open portion 54, at the lower edge 44*a* of these first, second, third and fourth mounting brackets 41*a*, 41*b*, 41*c*, 41*d*.

Thanks to the present invention, in any embodiment, the construction of the screening device allows to simplify the assembly of the battery module and the electromechanical actuator inside the rail by means of identical first, second, third and fourth mounting brackets.

In this way, the first, second, third and fourth mounting brackets are interchangeable and can thus allow the battery module and the electromechanical actuator to be mounted inside the rail respectively.

Of course, many modifications can be made to the above-described example embodiments without departing from the scope of the invention defined by the claims.

In a variant, not shown, the electromechanical actuator 8 comprises two gearboxes 12 and two output shafts 20, such that each output shaft 20 drives one of the reels in rotation. Each output shaft 20 opens into one side of the casing 17 of the electromechanical actuator 8. Each output shaft 20 is connected to a drive shaft of one of the reels, by means of fastening elements, not shown. The fastening elements of each output shaft 20 to one of the drive shafts are, for example, screw fastening elements. Each reel is thus rotated, at one of the tilters 13, by a drive shaft coupled with one of the output shafts 20 of the electromechanical actuator 8. In such a case, each output shaft 20 of the electromechanical actuator 8 is connected to a separate drive shaft. Furthermore, the first, second, third and fourth mounting brackets 41*a*, 41*b*, 41*c*, 41*d* are designed to have one of the drive shafts passing through them.

In a variant, not shown, the housing 43 of the battery module 16 may be made in one piece. In this case, the housing 43 comprises a passage opening, in particular for access to each of the first and second compartments 45*a*, 45*b*, so as to insert the energy storage elements 31 inside the housing 43 and, eventually, to remove them, when they are replaced, in particular according to a sliding movement. The one or more passage openings of the housing 43 are arranged at the first or second end of the housing 43. Moreover, the one or more passage openings of the housing 43 may be closed by a cover, so as to ensure that the energy storage elements 31 are held in position inside the housing 43.

In a variant, not shown, the motorized drive device 7 and, in particular, the first electronic control unit 19 of the electromechanical actuator 8 comprises charging elements configured to charge, in other words charge, in an ad hoc manner, the battery 30 from the electric energy supplied by an external electrical power source, not shown, which can be, for example, the photovoltaic panel, the auxiliary battery or the mains power supply, in particular when the battery 30 is insufficiently charged by the photovoltaic panel or the auxiliary battery.

In a variant, not shown, the first electronic control unit 19 is arranged outside the casing 17 of the electromechanical actuator 8 and, in particular, mounted on the rail 9, in particular inside or outside the rail 9.

In another example embodiment, not shown, the drive device 7 comprises a plurality of reels of the drive cords 5 and a plurality of tilters of the orientation cords 6, the reels being separate from the tilters. In this case, the drive cords 5 are connected, on the one hand, to the load bar 4 and, on the other hand, to the reels. The orientation cords 6 are connected to the load bar 4, the slats 3, as well as the tilters. In practice, the lower end of each drive cord 5 is connected to the load bar 4 and the upper end of each drive cord 5 is connected to one of the reels, in the assembled configuration of the screening device 1 in the home automation facility 100. The lower end of each orientation cord 6 is connected to the load bar 4 and the upper end of each orientation cord 6 is connected to one of the tilters, in the assembled configuration of the screening device 1 in the home automation facility 100. Preferably, the reels and the tilters are arranged inside the rail 9.

In another example embodiment, not shown, the drive device 7 comprises two chains for driving and orienting the slats 3 of the screen 2, replacing the drive cords 5 and the orientation cords 6. In a such case, each chain is arranged within a slide arranged along one side of the screen 2 of the screening device 1.

Furthermore, the contemplated embodiments and variants may be combined to generate new embodiments of the invention, without departing from the scope of the invention defined by the claims.

The invention claimed is:

1. A screening device, the screening device comprising at least:

a rail, a screen, a drive shaft, a motorized drive device, and an autonomous electrical power supply, the motorized drive device comprising at least:

an electromechanical actuator, the electromechanical actuator being arranged inside the rail, in an assembled configuration of the screening device, the electromechanical actuator being configured to move the screen by means of the drive shaft, the electromechanical actuator being electrically connected to the autonomous electrical power supply device, the electromechanical actuator comprising a first end and a second end, the second end being opposite to the first end, the autonomous electrical power supply device comprising at least:

a battery module, the battery module being arranged inside the rail, in the assembled configuration of the screening device, the battery module comprising a first end and a second end, the second end being opposite the first end, the battery module comprising at least:

a battery, a first mounting bracket, the first mounting bracket being arranged at the first end of the battery module, in the assembled configuration of the screening device, and a second mounting bracket, the second mounting bracket being arranged at the second end of the battery module, in the assembled configuration of the screening device, each of the first and second mounting brackets being arranged inside the rail and configured to hold the battery module inside the rail, in the assembled configuration of the screening device, the electromechanical actuator comprising at least:

a third mounting bracket, the third mounting bracket being arranged at the first end of the electromechanical actuator, in the assembled configuration of the screening device, and a fourth mounting bracket, the fourth mounting bracket being arranged at the second end of the electromechanical actuator, in the assembled configuration of the screening device, each of the third and fourth mounting brackets being arranged inside the rail and configured to hold the electromechanical actuator inside the rail, in the assembled configuration of the screening device, the first, second, third and fourth mounting brackets being identical, and each of the first, second, third and fourth mounting brackets comprising an opening, the opening of each of the first, second, third and fourth mounting brackets being configured to accommodate the drive shaft, in the assembled configuration of the screening device.

2. The screening device according to claim 1, wherein:

the battery module further comprises a housing, and the battery is arranged within the housing, in an assembled configuration of the battery module.

3. The screening device according to claim 2, wherein:

the housing of the battery module comprises a recess, and the recess of the housing is configured to accommodate the drive shaft, in the assembled configuration of the screening device.

4. The screening device according to claim 2, wherein:

the battery comprises a plurality of energy storage elements, the housing of the battery module comprises a first compartment and a second compartment, and each of the first and second compartments of the housing houses at least one of the energy storage elements.

5. The screening device according to claim 4, wherein:

the housing of the battery module comprises a recess, the recess of the housing is configured to accommodate the drive shaft, in the assembled configuration of the screening device, and the recess of the housing of the battery module is provided between the first and second compartments of the housing.

6. The screening device according to claim 2, wherein:

the housing of the battery module presents a width that is less than the width of the rail, the electromechanical actuator further comprises a casing, and the casing of the electromechanical actuator presents a width that is less than the width of the rail.

7. The screening device according to claim 1, wherein:

each of the first, second, third and fourth mounting brackets comprises at least one lower edge, one upper edge and two side edges, each of the first, second, third and fourth mounting brackets comprises a notch, at each of the side edges of these first, second, third and fourth mounting brackets, the rail comprises at least one bottom wall and two side walls, the rail comprises a protruding portion at each of the side walls of the rail, each protruding portion of the side walls of the rail facing towards the inside of the rail, and, in the assembled configuration of the screening device, each notch of one of the first, second, third and fourth mounting brackets is configured to cooperate with the protruding portion of one of the side walls of the rail, so as to immobilize each of the first, second, third and fourth mounting brackets inside the rail.

8. The screening device according to claim 1, wherein, in the assembled configuration of the screening device, the first, second, third and fourth mounting brackets are attached to the battery module or the electromechanical actuator, respectively, by means of connecting elements.

9. The screening device according to claim 1, wherein, in the assembled configuration of the screening device, the holding, on the one hand, of the battery module and, on the other hand, of the electromechanical actuator inside the rail is implemented by a pressure exerted by each of the first, second, third and fourth mounting brackets on an inner face of the rail.

10. The screening device according to claim 1, wherein:

the opening of each of the first, second, third and fourth mounting brackets comprises an open portion to an edge of these first, second, third and fourth mounting brackets, and the open portion of the opening of each of the first, second, third and fourth mounting brackets is configured to insert the drive shaft therein towards the inside of the opening of these first, second, third and fourth mounting brackets, upon assembly of the screening device.

11. The screening device according to claim 3, wherein:

the battery comprises a plurality of energy storage elements, the housing of the battery module comprises a first compartment and a second compartment, and each of the first and second compartments of the housing houses at least one of the energy storage elements.

12. The screening device according to claim 3, wherein:

the housing of the battery module presents a width that is less than the width of the rail, the electromechanical actuator further comprises a casing, and the casing of the electromechanical actuator presents a width that is less than the width of the rail.

13. The screening device according to claim 4, wherein:

the housing of the battery module presents a width that is less than the width of the rail, the electromechanical actuator further comprises a casing, and the casing of the electromechanical actuator presents a width that is less than the width of the rail.

14. The screening device according to claim 5, wherein:

the housing of the battery module presents a width that is less than the width of the rail, the electromechanical actuator further comprises a casing, and the casing of the electromechanical actuator presents a width that is less than the width of the rail.

15. The screening device according to claim 2, wherein:

each of the first, second, third and fourth mounting brackets comprises at least one lower edge, one upper edge and two side edges, each of the first, second, third and fourth mounting brackets comprises a notch, at each of the side edges of these first, second, third and fourth mounting brackets, the rail comprises at least one bottom wall and two side walls, the rail comprises a protruding portion at each of the side walls of the rail, each protruding portion of the side walls of the rail facing towards the inside of the rail, and, in the assembled configuration of the screening device, each notch of one of the first, second, third and fourth mounting brackets is configured to cooperate with the protruding portion of one of the side walls of the rail, so as to immobilize each of the first, second, third and fourth mounting brackets inside the rail.

16. The screening device according to claim 3, wherein:

each of the first, second, third and fourth mounting brackets comprises at least one lower edge, one upper edge and two side edges, each of the first, second, third and fourth mounting brackets comprises a notch, at each of the side edges of these first, second, third and fourth mounting brackets, the rail comprises at least one bottom wall and two side walls, the rail comprises a protruding portion at each of the side walls of the rail, each protruding portion of the side walls of the rail facing towards the inside of the rail, and, in the assembled configuration of the screening device, each notch of one of the first, second, third and fourth mounting brackets is configured to cooperate with the protruding portion of one of the side walls of the rail, so as to immobilize each of the first, second, third and fourth mounting brackets inside the rail.

17. The screening device according to claim 4, wherein:

each of the first, second, third and fourth mounting brackets comprises at least one lower edge, one upper edge and two side edges, each of the first, second, third and fourth mounting brackets comprises a notch, at each of the side edges of these first, second, third and fourth mounting brackets, the rail comprises at least one bottom wall and two side walls, the rail comprises a protruding portion at each of the side walls of the rail, each protruding portion of the side walls of the rail facing towards the inside of the rail, and, in the assembled configuration of the screening device, each notch of one of the first, second, third and fourth mounting brackets is configured to cooperate with the protruding portion of one of the side walls of the rail, so as to immobilize each of the first, second, third and fourth mounting brackets inside the rail.

18. The screening device according to claim 5, wherein:

each of the first, second, third and fourth mounting brackets comprises at least one lower edge, one upper edge and two side edges, each of the first, second, third and fourth mounting brackets comprises a notch, at each of the side edges of these first, second, third and fourth mounting brackets, the rail comprises at least one bottom wall and two side walls, the rail comprises a protruding portion at each of the side walls of the rail, each protruding portion of the side walls of the rail facing towards the inside of the rail, and, in the assembled configuration of the screening device, each notch of one of the first, second, third and fourth mounting brackets is configured to cooperate with the protruding portion of one of the side walls of the rail, so as to immobilize each of the first, second, third and fourth mounting brackets inside the rail.

19. The screening device according to claim 6, wherein:

each of the first, second, third and fourth mounting brackets comprises at least one lower edge, one upper edge and two side edges, each of the first, second, third and fourth mounting brackets comprises a notch, at each of the side edges of these first, second, third and fourth mounting brackets, the rail comprises at least one bottom wall and two side walls, the rail comprises a protruding portion at each of the side walls of the rail, each protruding portion of the side walls of the rail facing towards the inside of the rail, and, in the assembled configuration of the screening device, each notch of one of the first, second, third and fourth mounting brackets is configured to cooperate with the protruding portion of one of the side walls of the rail, so as to immobilize each of the first, second, third and fourth mounting brackets inside the rail.

20. The screening device according to claim 2, wherein, in the assembled configuration of the screening device, the first, second, third and fourth mounting brackets are attached to the battery module or the electromechanical actuator, respectively, by means of connecting elements.

* * * * *